United States Patent [19]

Maglica et al.

[11] Patent Number: 4,823,242

[45] Date of Patent: Apr. 18, 1989

[54] DOUBLE SWITCH MINIATURE FLASHLIGHT

[75] Inventors: Anthony Maglica, Ontario; Ralph E. Johnson, Los Alamitos; Armis L. Lewis, Cucamonga, all of Calif.

[73] Assignee: Mag Instrument, Inc., Ontario, Calif.

[21] Appl. No.: 215,725

[22] Filed: Jul. 6, 1988

Related U.S. Application Data

[60] Division of Ser. No. 111,538, Oct. 23, 1987, which is a continuation-in-part of Ser. No. 34,918, Apr. 6, 1987, abandoned, which is a continuation of Ser. No. 828,729, Feb. 11, 1986, Pat. No. 4,658,336, which is a continuation of Ser. No. 648,032, Sep. 6, 1984, Pat. No. 4,577,263.

[51] Int. Cl.[4] ..... F21L 7/00

[52] U.S. Cl. ..... 362/187; 362/205; 362/206; 200/60

[58] Field of Search ..... 362/157, 158, 187, 188, 362/202, 203, 204, 205, 206, 208; 200/60

[56] References Cited

U.S. PATENT DOCUMENTS

| | | | |
|---|---|---|---|
| 1,603,272 | 10/1926 | Ecton | 362/202 |
| 2,259,106 | 10/1941 | Haper | 362/205 |
| 4,286,311 | 8/1981 | Maglica | 362/202 |
| 4,327,401 | 4/1982 | Siiberg | 362/205 |
| 4,577,263 | 3/1986 | Maglica | 362/205 |
| 4,656,565 | 4/1987 | Maglica | 362/205 |
| 4,658,336 | 4/1987 | Maglica | 362/187 |
| 4,733,337 | 3/1988 | Bieburstein | 362/157 |

*Primary Examiner*—Ira S. Lazarus
*Assistant Examiner*—D. M. Cox
*Attorney, Agent, or Firm*—Lyon & Lyon

[57] ABSTRACT

A miniature two or three cell flashlight as disclosed to comprise a barrel, a tailcap, a head assembly, and means for holding a miniature lamp bulb and for providing interruptible electrical coupling to dry cell batteries retained within the barrel and having a recharger for charging the chargeable batteries via conductors in the tailcap.

12 Claims, 4 Drawing Sheets

DOUBLE SWITCH MINIATURE FLASHLIGHT

This is a divisional of copending application Ser. No. 111,538, filed Oct. 23, 1987 pending, which is a continuation-in-part of application Ser. No. 034,918, filed on Apr. 6, 1987, now abandoned which is a continuation of Ser. No. 828,729, filed Feb. 11, 1986, now U.S. Pat. No. 4,658,336 which is a continuation of Ser. No. 648,032, filed Sep. 6, 1984, now U.S. Pat. No. 4,577,263.

BACKGROUND OF THE INVENTION

1. Field of the Invention

The present invention relates primarily to flashlights, and in particular, to miniature hand-held flashlights which may have their batteries recharged and a recharger therefor.

2. Discussion of the Prior Art

Flashlights of varying sizes and shapes are well known in the art. In particular, certain of such known flashlights utilize two or more dry cell batteries, carried in series in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beam produced. Additionally, several advances have been achieved in the light emitting characteristics of flashlight lamp bulbs.

Since there exists a wide variety of uses for hand-held flashlights, the development of the flashlight having a variable focus, which produces a beam of light having a variable dispersion, has been accomplished.

Also, flashlights which may have their batteries recharged with a constant current recharger are known. However, such advances have heretofore been directed to "full-sized" flashlights.

SUMMARY OF THE INVENTION

It is a primary object of the present invention to provide miniature hand-held flashlights having a recharging capability.

It is another object of the present invention to provide miniature flashlights having three dry cell batteries as a power source.

It is another object of the present invention to provide miniature flashlights having various tailcap constructions.

It is another object of the present invention to provide miniature hand-held flashlights having improved optical characteristics.

It is another object of the present invention to provide a rechargeable miniature hand-held flashlight which is capable of producing a beam of light having a variable dispersion.

It is a further object of the present invention to provide a rechargeable miniature hand-held flashlight which is capable of supporting itself vertically on a horizon surface to serve as an "ambient" unfocused light source.

It is another object of the present invention to provide a rechargeable miniature hand-held flashlight wherein relative motions of components that produce the variation and the dispersion of the light beam provide an electrical switch function to open and complete the electrical circuit of the flashlight.

These and other objects of the present invention, which may become obvious to those skilled in the art through the hereinafter detailed description of the invention are achieved by a miniature flashlight and battery charger comprising: a cylindrical tube containing one or more miniature dry cell batteries and preferably three AA sized batteries which, when used with the charger should be suitable for charging, disposed in a series arrangement, a lamp bulb holder assembly including electrical conductors for making electrical contact between terminals of a miniature lamp suitable for use with rechargeable batteries, and the cylindrical tube and an electrode of the battery, respectively, retained in one end of the cylindrical tube adjacent the batteries, a tail cap and spring member enclosing the other end of the cylindrical tube and providing an electrical contact to another electrode of the batteries and providing for charging of the batteries within the tube, and a head assembly including a reflector, a lens, a face cap, which head assembly is rotatably mounted to the cylindrical tube such that the lamp bulb extends through a hole in the center of the reflector within the lens and a charger housing which may be electrically coupled to the tube at the tailcap. In the preferred embodiment of the present invention, the batteries are of the size commonly referred to as AA batteries.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tailcap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tailcap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the head assembly may be placed, lens down, on a substantially horizontal surface and the tailcap and cylindrical tube may be vertically inserted therein to provide a miniature "table lamp".

The flashlights of the present invention preferably include three AA size batteries or smaller, suitable for charging when the charger is used. When the battery charger feature is used, a tailcap having the features shown and described herein provides a charging circuit for the batteries without removal of the batteries from the flashlight. When a charging feature is not desired, then any one of a variety of other tailcaps may be used. For example, a tailcap having a lanyard ring construction may be used. Alternatively, a tailcap having an insert and of the construction shown in co-pending application, Ser. No. 043,086, filed on Apr. 27, 1987, entitled FLASHLIGHT, may be used. Also, tailcaps not having the lanyard ring holder feature and not having the charger feature may be used. Such tailcaps would have a smooth, contoured external appearance, as shown in FIGS. 7 and 10 of the drawings. Furthermore, a tailcap having a lanyard ring feature as well as a charging feature may be used with the flashlights of the present invention, although a tailcap not having a lanyard ring is preferred when using the charging feature.

The charger for the flashlights of the present invention includes a housing, a circuit adapted to receive electrical power within a certain voltage range and to provide constant current at a predetermined rate to the batteries, and positive and negative contacts for contacting with positive and negative charging regions on the tailcap, which in turn and together with the electrical circuit of the flashlight provide for a charging circuit to the batteries. The charger may be adapted to convert AC to DC, and may be adapted to provide for various charging rates. The charger and the tailcap also contain a blocking diode to prevent a reverse charging condition to occur.

DETAILED DESCRIPTION OF PREFERRED EMBODIMENTS

Figure 2:
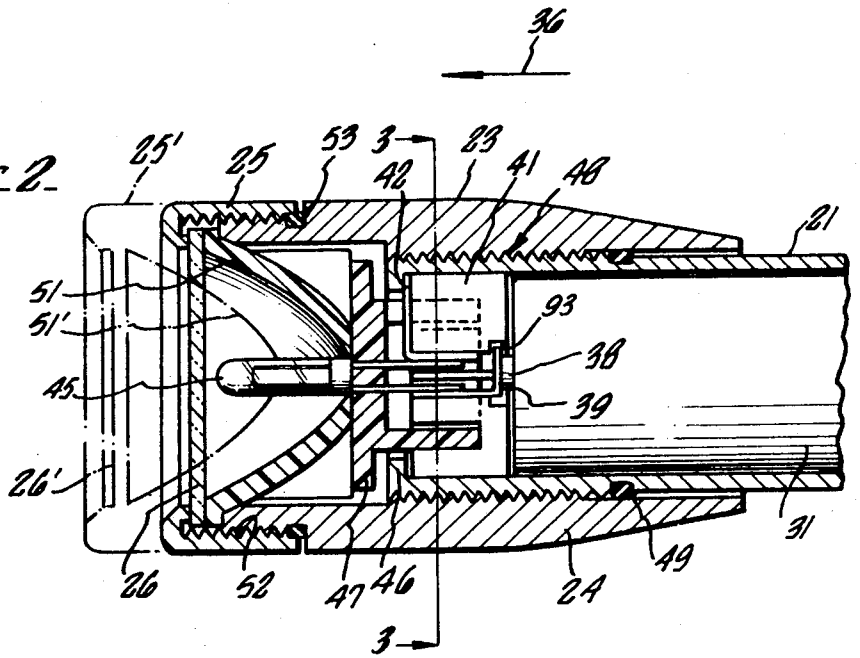
FIG. 2 is a partial cross-sectional view of a forward end of the miniature flashlight, illustrating, in ghost image, a translation of the forward end of the flashlight.

Referring to FIGS. 1–8 and 10–13, a miniature flashlight 20 in accordance with the present invention is illustrated. The miniature flashlight 20 is comprised of a generally right circular cylinder, or barrel 21 enclosed at a first end by a tailcap/switch assembly 94 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tailcap 22 may be configured to include provision for attaching a handling lanyard through a hole in a tab formed therein.

Figure 1:
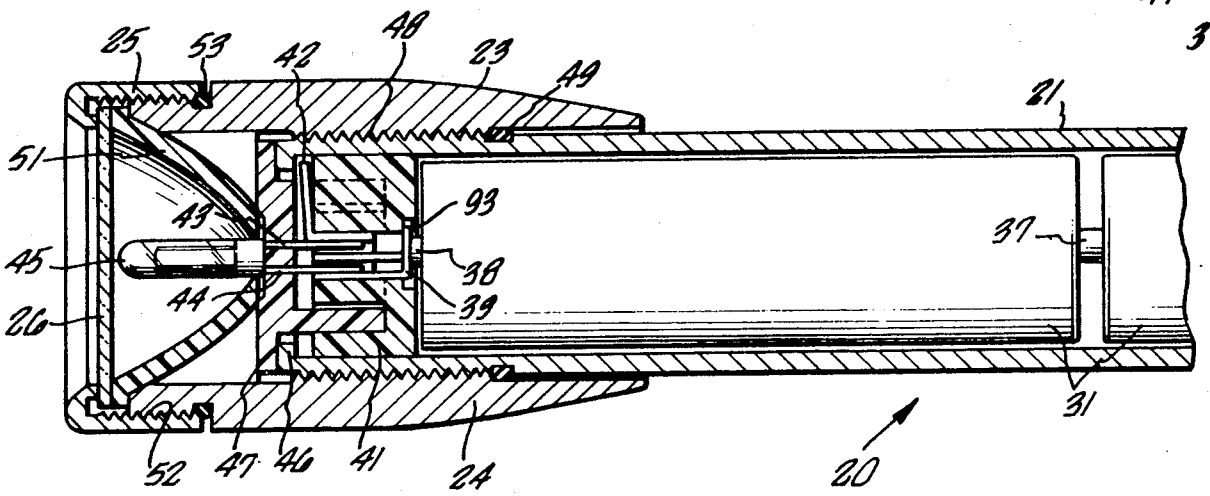
FIG. 1 is a partially foreshortened cross-sectional view of the head assembly and front battery of a preferred embodiment of the miniature flashlight of the present invention.
Figure 7:
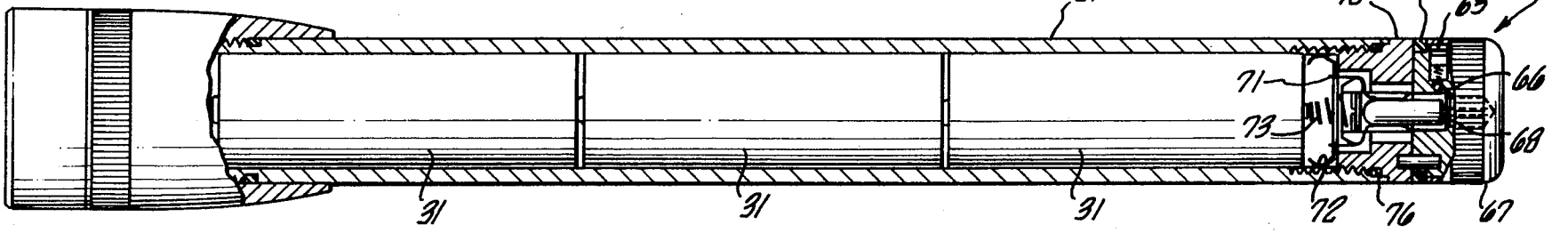
FIG. 7 is a partial cross-sectional view of a preferred embodiment of the present invention, showing the three battery construction and details of the tailcap used with the battery charging unit.

Referring to FIG. 7, barrel 21 is seen to have an extent sufficient to enclose three miniature dry cell batteries 31 disposed in a series arrangement and suitable for recharging. As shown in FIG. 1, the center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45 suitable for use with rechargeable batteries and a charger, preferably a high pressure, Xenon gas filled type of lamp. Absent further assembly, the lower insulator receptacle is urged in the direction indicated by the arrow 36, by the action of the spring 73, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a water-tight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. O-rings 53 and 53A may be incorporated at the interface between the face cap 25 and the head 24 and between face cap 25 and lens 26, respectively, to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Referring next to FIG. 2, appropriate rotation of the head 24 about the axis of the barrel 21 causes the head assembly 23 to move in the direction indicated by the arrow 36 through the engagement of the threads 48. Upon reaching the relative positons indicated in FIG. 2 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 73 (FIG. 7) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 2, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to the parabola of the reflector 51, thereby varying the dispersion of the light beam emanating from the lamp bulb 45 through the lens 26.

Figures 3, 4, 5, 6:
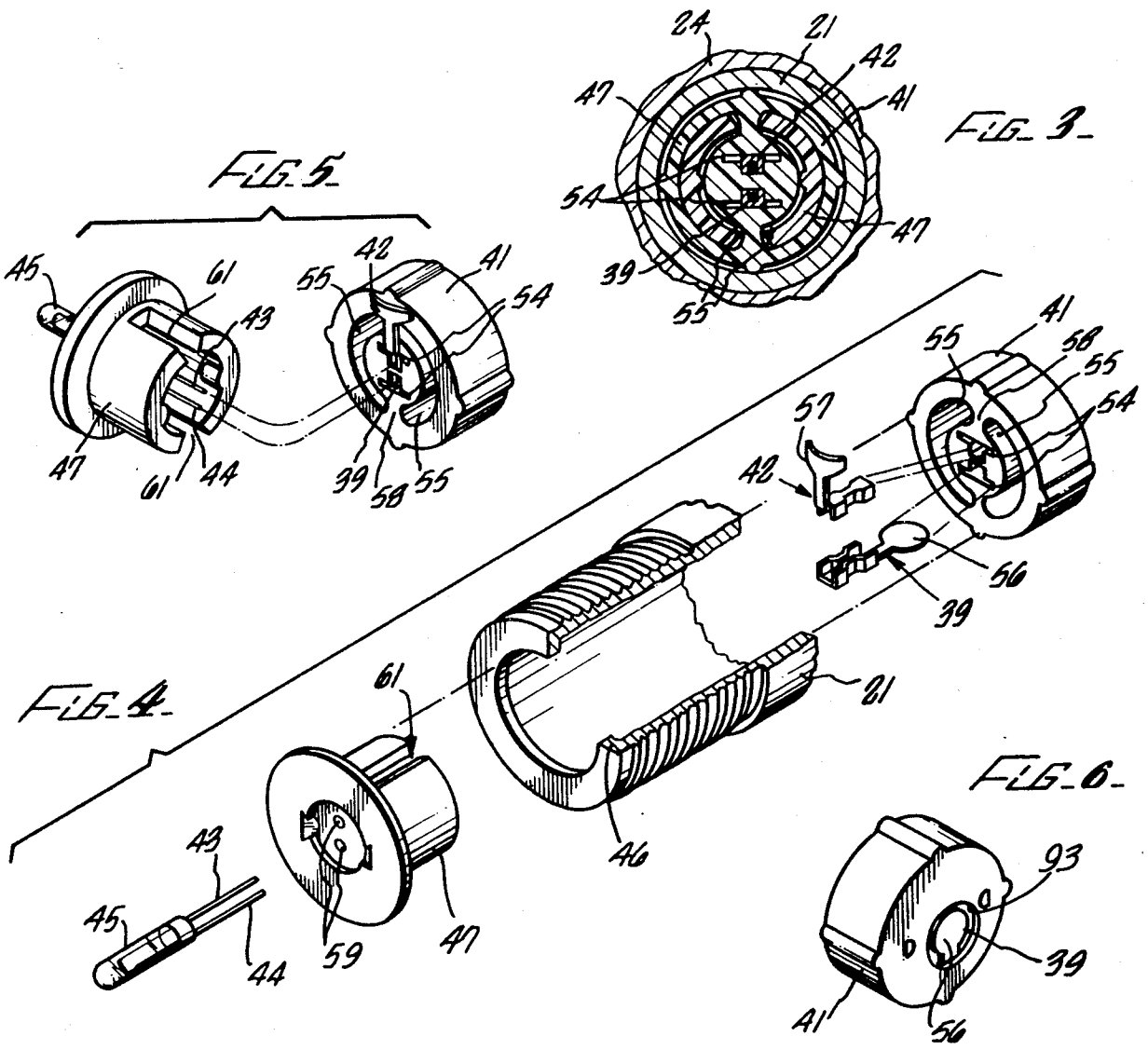
FIG. 3 is a partial cross-sectional view of a lamp bulb holder assembly used in accordance with the present invention, taken along the plane indicated by 3—3 of FIG. 2.
FIG. 4 is an exploded perspective view illustrating the assembly of the lamp bulb holder assembly with respect to a barrel of the miniature flashlight.
FIG. 5 is an isolated partial perspective view illustrating the electromechanical interface between electrical terminals of the lamp bulb and electrical conductors within the lamp bulb holder.
FIG. 6 presents a perspective view of a rearward surface of the lamp bulb holder of FIG. 4, illustrating a battery electrode contact terminal.

Referring next to FIG. 3, a partial cross-sectional view ilustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 4 through 6, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward end of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 1. Insulator 41 has a cup-shaped recess 93 in its center sized to accomodate the center electrode of a battery and provide contact at end section 56, as shown in FIGS. 2, 3 and 7. If the batteries are inserted backwards so that the center battery electrode is facing toward the tailcap, there will be no possibility of a completed electrical circuit. This feature provides for additional protection during charging, there being the possibility of damage resulting if the batteries are placed in backwards and charging attempted. The side contact conductor 42 is then inserted into the other slot 54 such that a radial projection 57 extends outwardly from the axial center of the lower insulator receptacle 41. It is to be noted that the radial projection 57 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. After inserting the upper insulator receptacle 47 the lamp electrodes 43 and 44 are then passed through a pair of holes 59 formed through the forward surface of the upper insulator receptacle 47 so that they project outwardly from the rear surface thereof as illustrated in FIG. 6. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21.

Referring again to FIGS. 1, 2 and 10, the electrical circuit of the miniature flashlight in accordance with the present invention will now be described.

Electrical energy is conducted from the rearmost battery 31 through its center contact 37 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 1, the side contact conductor 42 does not contact the lip 46 of the barrel 21, thereby resulting in an open electrical circuit. However, when the head assembly 23 has been rotated about the threads 48 to the positon illustrated by the solid lines of FIG. 2, the side contact conductor 42 is pressed against the lip 46 by the lower insulator receptacle 41 being urged in the direction of the arrow 36 by the spring 73 of FIG. 10. In this configuration, electrical energy may then flow from the side contact conductor 42 into the lip 46, through the barrel 21 and into the tailcap/switch assembly 94 of FIG. 7. The spring 73 electrically couples the tailcap/switch assembly 94 to the case electrode of the rearmost battery 31. By rotating the head assembly 23 about the threads 48 such that the head assembly 23 moves in a direction counter to that indicted by the arrow 36, the head assembly 23 may be restored to the postion illustrated in FIG. 2, thereby opening the electrical circuit and turning off the flashlight.

In a preferred embodiment, the barrel 21, the tailcap/switch assembly 94, the head 24, and the face cap 25, forming all of the exterior metal surfaces of the miniature flashlight 20 are manufactured from aircraft quality, heat-treated aluminum, which is annodized for corrosion resistance. The sealing O-rings 33, 49, 53, and 53A provide atmospheric sealing of the interior of the miniature flashlight. All interior electrical contact surfaces are appropriately machined to provide efficient electrical conduction. The reflector 51 is a computer generated parabola which is vacuum aluminum metallized to ensure high precision optics. The threads 48 between the head 24 and the barrel 21 are machined such that revolution of the head assembly will open and close the electrical circuit as well as provide for focusing. A spare lamp bulb 68 may be provided in a cavity machined in the tailcap/switch assembly 94.

Figure 8:
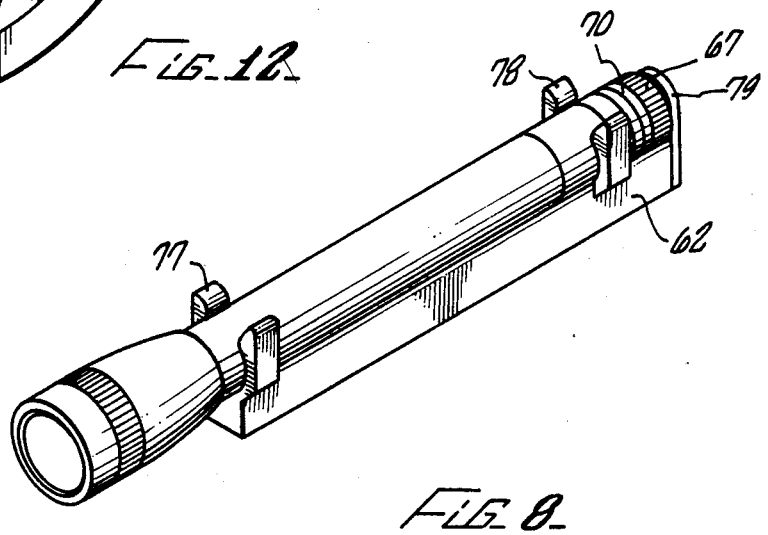
FIG. 8 is a perspective view of the FIG. 7 flashlight within the battery charger housing of the present invention.
Figure 9:
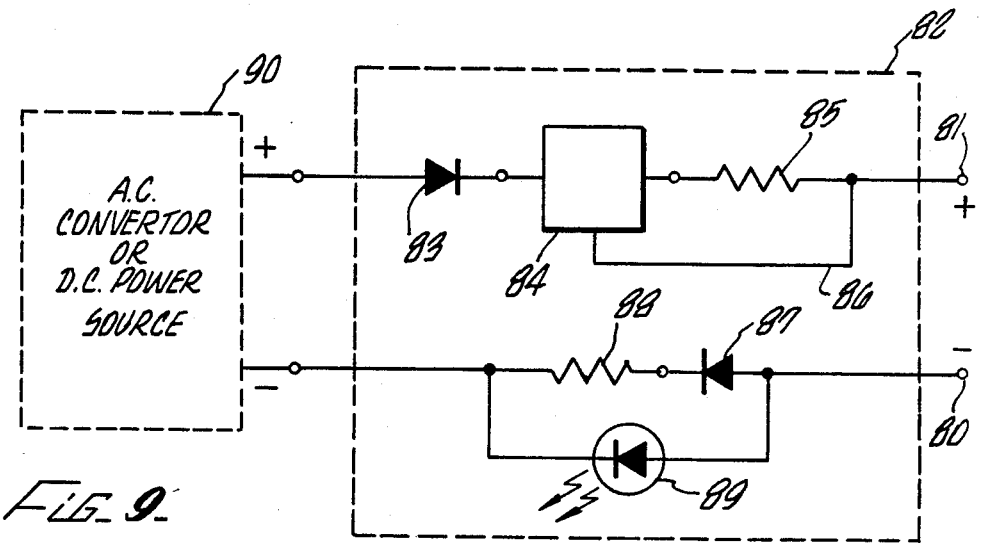
FIG. 9 is a schematic diagram of the circuit for the FIG. 8 battery charger of the present invention.

By refererence to FIGS. 7–13 other features of the recharging feature of the preferred embodiments will be described. FIG. 7 shows a partial cross-sectional view of a flashlight having three dry cell batteries and a tailcap/switch assembly 94 especially adapted to be used in conjunction with a battery charger. The battery charger housing 62 is shown in FIG. 8 and a schematic diagram of the circuit for the charger is shown in FIG. 9.

Figure 10:
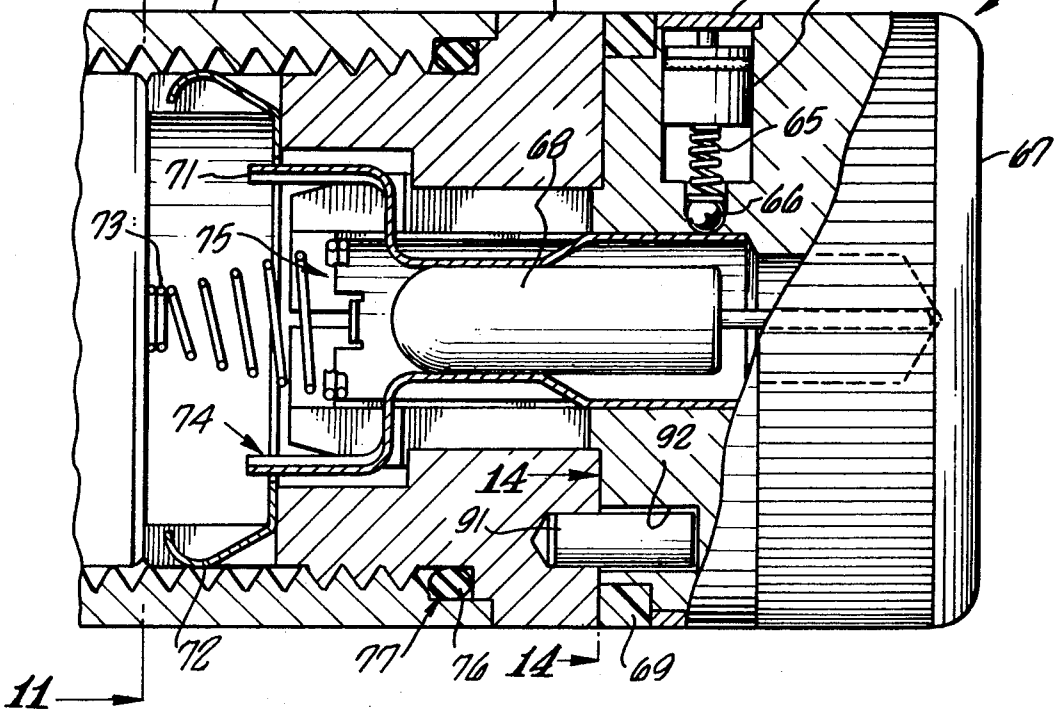
FIG. 10 is an enlarged cross-sectional view the tailcap of the FIG. 7 flashlight.

As shown in more detail in FIG. 10, the tailcap/switch assembly 94 includes negative charge ring 63, diode 64, diode spring 65, ball 66, switch knob 67, a spare lamp 68, insulator 69, positive charge region or ring 70, switch contact 71, ground contact 72 and battery spring 73.

When the flashlight is not in a battery charging mode, the tailcap may be used as an alternate flashlight switch to turn the flashlight on or off while maintaining a certain, predetermined focus for the light beam. As shown in greater detail in FIG. 10, the tailcap/switch assembly 94 is in the "charge" position for charging and in the "off" position for normal flashlight operation. In the tailcap position shown, with the head of the flashlight rotated to be in the "on" position as described previously, the circuit is broken between switch contact 71 and ground contact 72 at the region of scallop 74. In this position the forward ends of the switch contact 71 extend up through the scallop holes 74 cut in the ground contact 72, but do not touch any part of ground contact 72. The scallops are also shown in FIG. 11.

Thus, the circuit from the barrel to ground contact 72 is broken at 74. As shown, the remainder of the circuit after the break is from switch contact 71 to battery spring 73 to the electrode of the rearmost battery and thereafter to and through the head assembly as previously described.

When the switch knob 67 is rotated in a counterclockwise direction 30 degrees, encased switch contact 71 also rotates 30 degrees, and the forward extensions of switch contact 71 come in contact with ground contact 72 at the scallops 74. As shown in FIGS. 10 and 12 pin 91 is positioned within the positive contact region 70 of the tailcap and extends into slot 92 of switch knob 67 to provide a stop for the switch knob 67. The pin 91 and slot 92 provide for a 30 degree rotation of the knob 67 to place the switch contact 71 into contact with ground switch 72. In this position, as shown in phantom in FIG. 11, during normal flashlight operation with the head rotated so that the flashlight is "on" the current flowpath in the tailcap region is from the barrel to the ground contact 72 to switch contact 71 where they touch at 74, then to battery spring 73 to the rearmost battery electrode.

Figure 11:
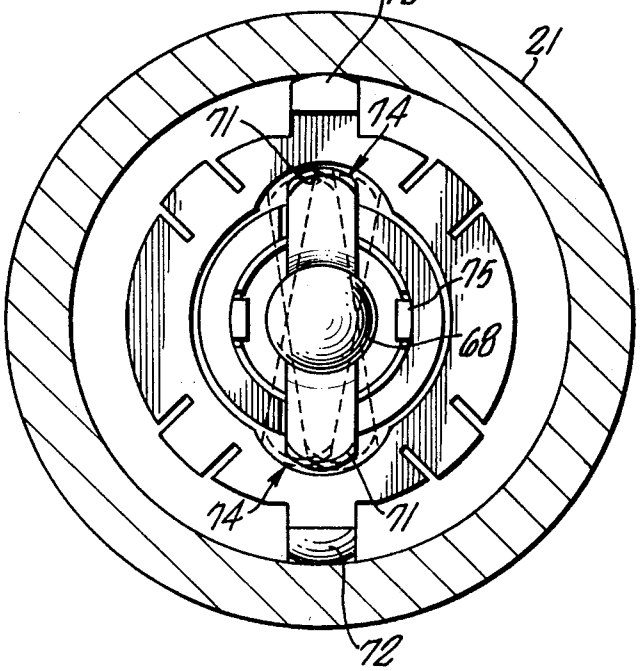
FIG. 11 is a plan view taken along line 11—11 of the FIG. 10 tailcap.
Figure 12:
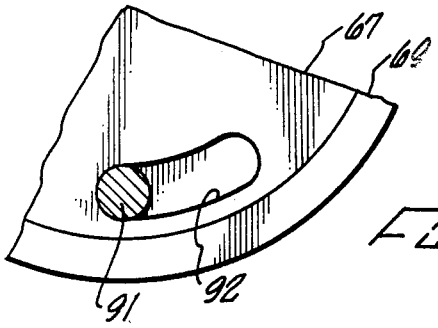
FIG. 12 is a plan view of switch knob 67.

The forward end of the main barrel portion of switch contact 71 contains tabs 75, also shown in FIG. 11, which are bent inward to form a shoulder against which the battery spring 73 rests as shown in FIGS. 10 and 11.

The switch contact 71 and negative charge ring 63 are preferably made of machined aluminum or other suitable conductive material. The switch knob 67 and insulator 69 are preferrably made of plastic or other suitable insulative material. The ball 66 is made of brass, bronze or other suitable conductive material. The springs 73 and 65 are preferably made of metal or alloy which has good spring as well as good electrical conductivity properties, such as berylium copper. The contacts 71 and 72 are also perferably made of conductive metal, such as berylium copper.

Figure 13:
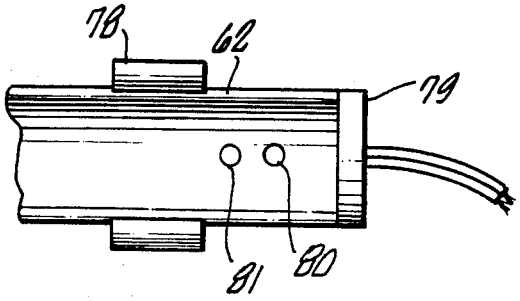
FIG. 13 is a partial top view of the charger of FIG. 8.

When the flashlight is in the charging mode negative charge ring 63 is in contact with the negative contact of the charger housing, as shown in FIGS. 8 and 13. The positive charge region 70 of the tailcap/switch assembly 94 is in contact of the charger housing, as shown in FIGS. 8 and 13. The aluminum portion of tailcap/switch assembly 94 is annodized except for the positive charge region 70, which has either not been annodized or which has had the annodized surface removed, as for example, by machining. An O-ring 76 is placed in the step 77 of the tailcap/switch assembly 94 to provide a water-tight seal, as at other locations described previously.

For charging, the flashlight is placed into the charger housing 62, as shown in FIGS. 8 and 13. The housing is made of a plastic, non-conductive material and includes front tongs 77, rear tongs 78 and foot 79. As shown in FIG. 13, negative housing contact 80 and positive housing contact 81 are positioned on the surface of the housing such that upon insertion of the flashlight into the tongs and placement so that the tailcap is resting against foot 79, the housing contacts 80, 81 match up to and establish contact with negative charge ring 63 and positive charge region 70, respectively.

The circuit, as schematically shown in FIG. 9, is built into the charger housing 62 and receives its power from an external source, not shown. The circuit may be a potted module or printed circuit board. As shown, the circuit is for a 12 volt DC power supply, such as from a car battery or its equivalent. The charger housing may be fitted with a cord and plug for connecting to the external power source, or, optionally, may have a suitable plug built into the charger housing 62.

As shown in FIG. 9 the circuit has a housing 82, and a positive input line which contains blocking diode 83. Diode 83, preferably a $I_f$ 1.0 amp, $E_R$ 50 volt diode, permits current to flow only from left to right, in order to protect the circuit, flashlight and batteries. In the preferred embodiment the circuit is designed for DC input of 6–28 volts, with a voltage regulator 84 used to provide constant current to the batteries being charged. The voltage regulator 84 is preferably a standard integrated circuit voltage regulator having overload and temperature protection features. A 12.5 ohm resister 85 and adjustment leg 86 complete the positive line input circuitry to the positive contact 81 of the battery charger housing 62.

In the negative, output line, of the charger circuit, diode 87 and 9 ohm resistor 88 are placed in parallel with LED 89 to develop a voltage of about 1.8 volts for energizing and lighting LED 89 when the batteries are being charged.

Optionally, as shown in phantom lines in FIG. 9 is an AC converter, e.g., 120 VAC: 12.6 VDC, or DC power source which may be included with the charger or provided as an optional component so that the battery charger may be charged from a standard wall outlet.

As is shown in FIG. 9 the circuit provides for constant current supply to the batteries when charging. A typical charging rate would provide for a full charge to a completely dead battery in about 5 hours. By varying the values of resistors 85 and 88, the battery design and power supply the charging rate may be increased or decreased as desired.

When the flashlight is being charged, the tailcap 61 is rotated to be in the position shown in FIGS. 7 and 10. In that position and while charging, the current flowpath is from the external power source through the positive input line of the circuit shown in FIG. 9, to positive contact 81 of the charger housing, to positive charge region 70 of the tailcap and then to the barrel of the flashlight, the switch contact 71 and ground contact 72 not touching at scallops 74. The current flow is then up to and through the components of the head assembly, as described previously. It should be noted, however, that the flashlights of the construction of the preferred embodiments must have the head rotated to the on position in order for charging to take place, that is, the circuit must be closed at conductor 42 and the lip 46 of barrel 21. With charging current then flowing down through the batteries to spring 73, as shown in FIG. 12, charging current re-enters the tailcap. From spring 73 current passes to switch contact 71, to ball 66, and then to diode 64, which also as a safety feature, provides for only one-way current flow, and then to negative charge ring 63, which is in contact with the negative charging contact 80 of the housing, as shown in FIG. 13.

A battery charging system of the present invention may be adapted for use with flashlights having one or more batteries, and with AA, or smaller sized rechargeable batteries, for example Ni-Cad batteries.

While we have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

We claim:

1. A flashlight comprising:
battery retaining means;
a lamp bulb;
means for holding the lamp bulb
a substantially parabolic reflector;
a substantially planar lens;
means for retaining the reflector and the lens at one end of said battery retaining means;
first switch means for switching the flashlight on or off and for changing the focus of the flashlight by rotation of the means for retaining the reflector and the lens; and
a tailcap including a second switch means for switching the flashlight on or off by rotation of the tailcap through a predetermined angle when said flashlight is placed in its on position by said first switch means.

2. The flashlight of claim 1 wherein the flashlight is a miniature flashlight.

3. The flashlight of claim 1 wherein the battery retaining means is sized to contain three AAA size batteries.

4. The flashlight of claim 1 wherein the battery retaining means is sized to contain three AA size batteries.

5. The flashlight of any of claims 1, 2, 3 or 4 wherein the battery retaining means is a cylindrical barrel.

6. The flashlight of claim 1 wherein the first switch means includes means for providing current flow in only one direction.

7. The flashlight of claim 6 wherein the means for providing current flow in only one direction is a recess formed in an insulator portion of the first switch means and wherein the recess is sized to accommodate the center electrode of a battery.

8. The flashlight of claim 1 wherein the second switch means includes a rotatable switch knob, a rotatable switch contact positioned in an interior region of the tailcap and cooperatively engaged to the switch knob, and a ground contact positioned in an interior region of the tailcap,
whereby rotation of the switch knob through the predetermined angle causes rotational movement of the switch contact sufficient to bring it into contact with the ground contact.

9. A miniature flashlight comprising;
a barrel sized to accommodate at least one battery,
a head assembly rotatably engageable with the barrel,
a tailcap rotatably engageable with the barrel,
a first switch means for switching the flashlight in which rotation of the head assembly towards the barrel turns off the switch, means rotation of the head assembly away from the barrel turns on the switch and rotation of the head assembly in either direction moves at least one battery, and a second switch means for switching the flashlight when the first switch means is in an on position and wherein said second switch means is located in said tailcap.

10. The flashlight of claim 9 wherein the first switch means includes means for providing current flow in only one direction.

11. The flashlight of claim 10 wherein the means for providing current flow in only one direction is a recess formed in an insulator portion of the first switch means and wherein the recess is sized to accommodate the center electrode of a battery.

12. The flashlight of claim 9 wherein the second switch means includes a rotatable switch knob, a rotatable switch contact positioned in an interior region of the tailcap and cooperatively engaged to the switch knob, and a ground contact positioned in an interior region of the tailcap, whereby rotation of the switch knob through a predetermined angle causes rotational movement of the switch contact sufficient to bring it into contact with the ground contact.

* * * * *

UNITED STATES PATENT AND TRADEMARK OFFICE

CERTIFICATE OF CORRECTION

PATENT NO. : 4,823,242

DATED : April 18, 1989

INVENTOR(S) : Anthony Maglica, Ralph E. Johnson and Armis L. Lewis

It is certified that error appears in the above-identified patent and that said Letters Patent is hereby corrected as shown below:

In column 10, line 67, insert the word "first" before the word "switch".

In column 10, line 67, after the word "switch" delete the comma and insert a comma after the word "means".

In column 11, line 1, the word "first" should be inserted before the word "switch" and the word "means" should be inserted after the word "switch".

Signed and Sealed this

Tenth Day of April, 1990

*Attest:*

HARRY F. MANBECK, JR.

*Attesting Officer*

*Commissioner of Patents and Trademarks*